United States Patent [19]

Guhl et al.

[11] Patent Number: 4,763,808

[45] Date of Patent: Aug. 16, 1988

[54] HOLDFAST AND SUPPORT SYSTEM FOR AN ELASTIC PLASTIC CONTAINER LINER

[76] Inventors: Jay R. Guhl; Salena S. Guhl, both of 1695 Martinez St., San Leandro, Calif. 94577

[21] Appl. No.: 57,771

[22] Filed: Jun. 3, 1987

[51] Int. Cl.[4] ..... B65D 90/04

[52] U.S. Cl. ..... 220/404; 220/1 T; 248/100

[58] Field of Search ..... 220/404, 1 T, 95, 96; 248/95, 99, 100

[56] References Cited

U.S. PATENT DOCUMENTS

| | | | |
|---|---|---|---|
| 1,435,637 | 11/1922 | Goldman | 248/100 X |
| 3,402,848 | 9/1968 | Busey . | |
| 4,332,361 | 6/1982 | McClellan | 248/95 |
| 4,418,835 | 12/1983 | Watts | 220/404 |
| 4,535,911 | 8/1985 | Goulter | 220/404 |
| 4,558,800 | 12/1985 | Isgar et al. | 220/1 T X |
| 4,576,310 | 3/1986 | Isgar et al. | 220/404 |
| 4,664,347 | 5/1987 | Brown et al. | 220/1 T X |

*Primary Examiner*—Steven M. Pollard

*Attorney, Agent, or Firm*—James R. Cypher

[57] ABSTRACT

A holdfast and support system for supporting a plastic bag in a receptacle. The holdfast consists of a member for bearing against the inside and outside faces of the sides of the receptacle and arms for engaging the handles of the plastic bag.

9 Claims, 3 Drawing Sheets

HOLDFAST AND SUPPORT SYSTEM FOR AN ELASTIC PLASTIC CONTAINER LINER

BACKGROUND OF THE INVENTION

The American public consumes about 22 billion grocery sacks a year in carrying groceries from markets to their homes. A high percentage of these sacks are recycled by lining waste receptacles for the disposal of garbage. Since 1979, plastic bags with handles, known as "t-shirt" bags have begun to replace paper sacks, and it is estimated that plastic bags now constitute 38 to 40% of the market and expect to capture 50% by 1988. The American public would like very much to recycle the plastic bags as before, but unless their waste receptacles are just the right size and formed with a flanged rim, the plastic bags are very unsatisfactory as waste receptacle liners.

Several prior art systems for recycling plastic bags have been patented, but have not proven commercially acceptable. The most common systems require some modification of the waste receptacle either at the factory or by the homeowner. These systems are unsatisfactory because they are expensive or don't work satisfactory with the elastic plastic containers known as "T-shirt" bags used by supermarkets.

Other prior art systems require a bracket to be permanently affixed to the waste receptacle by means of screws, bolts or even welding or adhesive methods. While these systems work satisfactorily if the receptacle is properly sized to the plastic container liner, they have not been widely accepted because of the reluctance of consumers to take the time to permanently affix the devices to their receptacles.

Still another prior art device has been patented which attempts to snap on to the rim of a waste receptacle. This device has not yet been marketed due to the expense of making the system and the necessity of having a special type receptacle with a specially constructed rim or flange.

Since plastic bags are 30 to 60% cheaper than paper bags, take up less space and are considerably lighter than paper bags, the grocery industry is anxious for the public to accept the plastic bags. The public, on the other hand is so accustomed to recycling grocery sacks as liners for waste receptacles that they are interested only in a device which is inexpensive, does not require any tools to afix the device to the container and will fit a variety of different size receptacles.

SUMMARY OF THE INVENTION

The gist of the present invention is a holdfast which is inexpensive and easily attached to existing waste receptacles of most any shape or size and with or without a flanged rim.

The primary objective is to promote and enable the public to recycle throw-away plastic containers formed with handles known as "T-shirt" bags. These plastic bags are used by retailers to bag groceries and other consumer products and are given to consumers without charge. Without a support system, these plastic bags are unsatisfactory for use in lining waste receptacles for the temporary retention of garbage and other household waste products.

Since plastic bags used as container liners are stronger than paper bags and capable of holding wet garbage, liquids, and even oils, another objective is to provide a system for holding the plastic container liners and to encourage the public to properly dispose of such wastes and to recycle an even higher percentage of the throw-away bags given away by retailers.

Since plastic container liners can be tied after filling and the contents securely contained; unlike paper bags which will spill their contents if tipped; an object of the present invention is to provide a system which enables the handles of the plastic container liner to be easily grasped, removed from its receptacle and tied and thus contribute to the orderly disposal of household wastes.

A further object is to provide a superior holding system for recycling plastic bags as container liners which are made from our abundant supplies of natural resources of gas and coal and which will encourage their use over more costly and less suitable paper bags which are made from wood products and deplete our dwindling forests.

A still further object is to provide an interactive elastic container support system in which the holdfast members stretch the upper side wall edges of the elastic container liner into relatively taut and straight lines to maximize and clearly define the opening in the elastic plastic container liner.

An object is to provide a holdfast which does not require any fastening system or adhesive to attach the holdfast to a receptacle.

Another object is to provide a holdfast which will hold open a plastic bag to the same wide opening regardless of whether the bag is empty or filled with heavy garbage.

A further object is to provide a holdfast which will easily attach to large standard garbage cans and hold a plastic container liner with handles even with the lid on.

Still another object is to provide a system for holding plastic bags open within a receptacle for the receipt of food products as for example separation of animal or fowl parts during processing.

Another object is to provide a modified form of the invention primarily made from plastic which will provide a more aesthetic holdfast which can be formed in colors and will promote the recycling of plastic bags in waste receptacles which are more visibly located.

A still further object is to provide a modified form of the invention which presents a lower profile and will permit use of the holdfasts on receptacles located in more height restricted locations such as beneath sinks and counters.

DESCRIPTION OF THE PREFERRED EMBODIMENTS OF THE INVENTION

Figure 1:
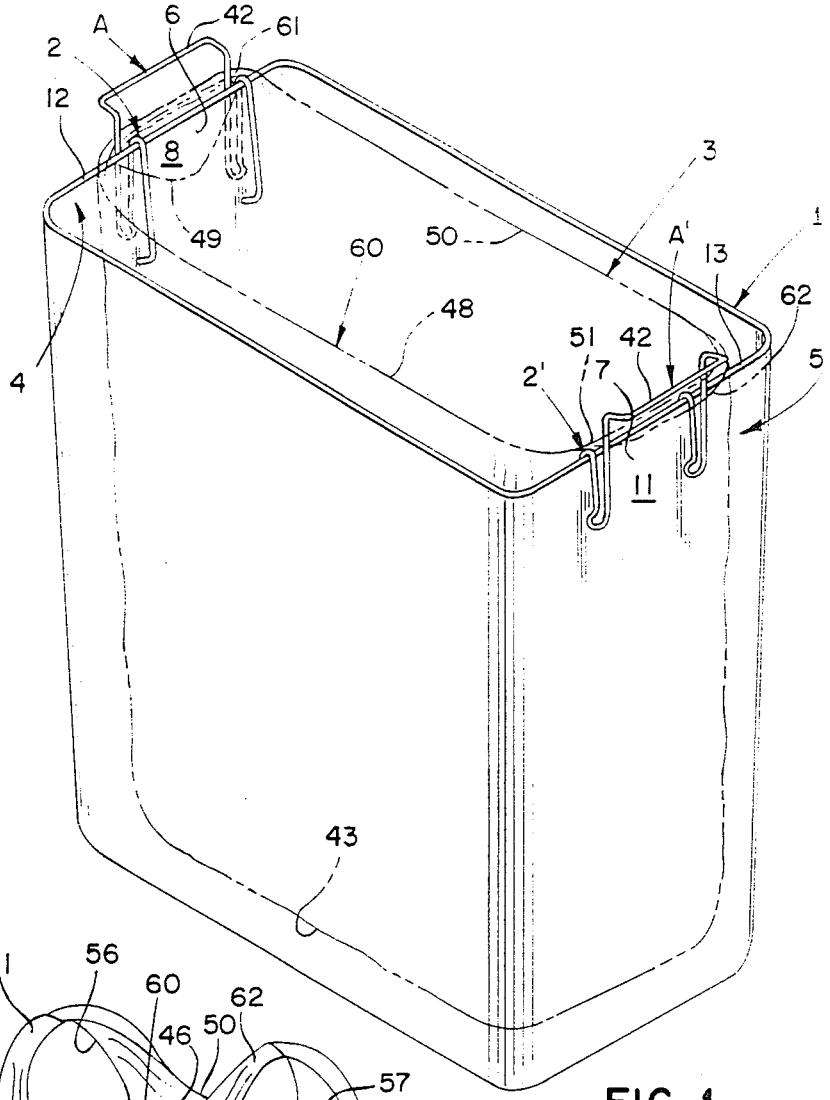
FIG. 1 is a perspective view of the preferred form of the elastic container liner support system of the present invention.
Figure 2:
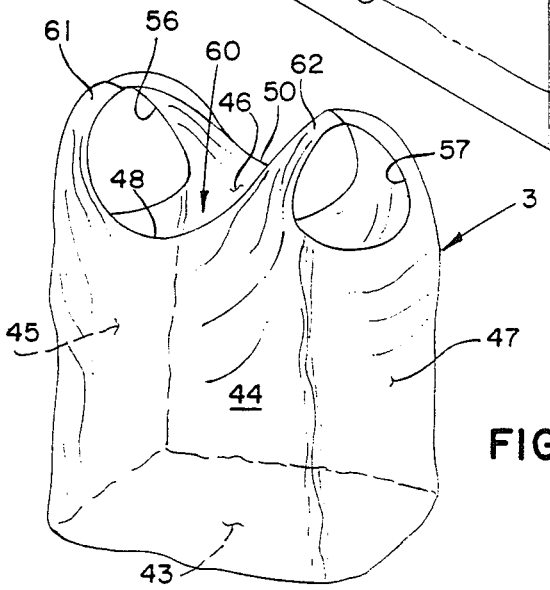
FIG. 2 is a perspective view on a reduced scale of an elastic container liner used in the support system of the present invention.
Figure 3:
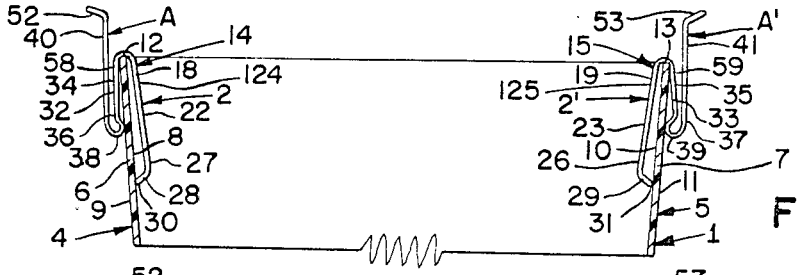
FIG. 3 is a side view of the holdfasts shown in FIG. 1 with a portion of the receptacle shown in cross section.
Figure 4:
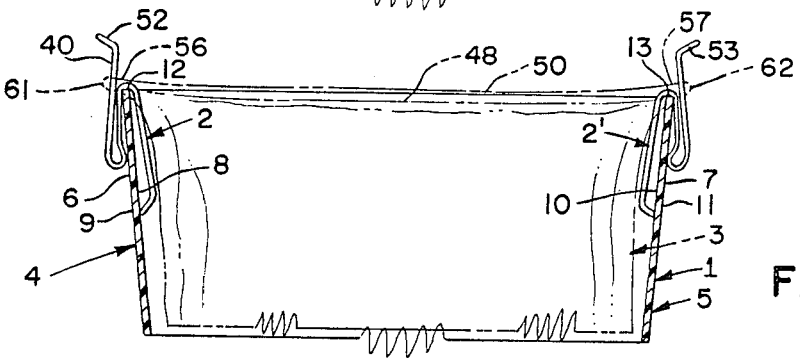
FIG. 4 is a view similar to FIG. 3 with the holdfasts holding an elastic plastic container liner showing the interaction between the holdfasts, the elastic plastic container liner and the receptacle.
Figure 5:
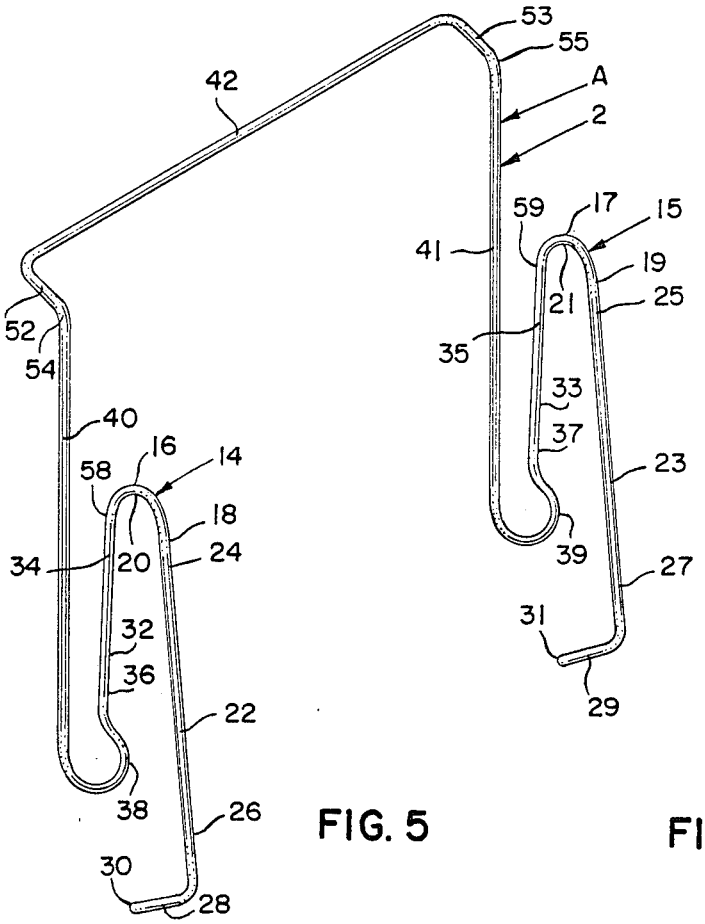
FIG. 5 is a perspective view on an enlarged scale of one of the holdfasts shown in FIG. 1.
Figure 6:
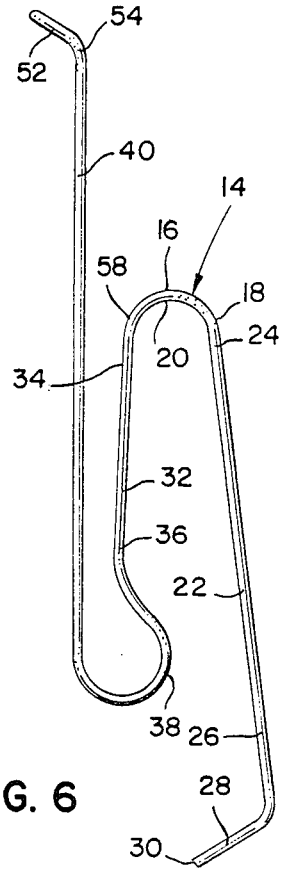
FIG. 6 is a side view of the holdfast shown in FIG. 5.
Figure 7:
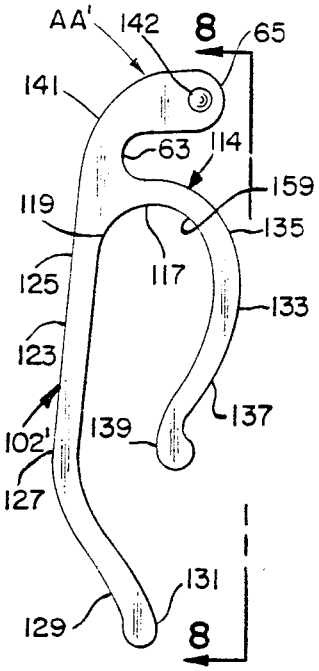
FIG. 7 is a side view of another form of holdfast.
Figure 8:
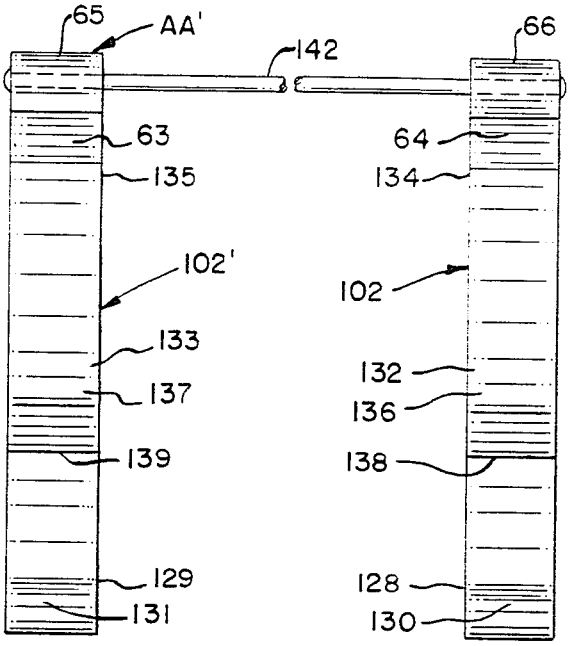
FIG. 8 is a view of the holdfast shown in FIG. 7 taken along line 8—8.

This application describes two forms of holdfasts; those made of spring metal, and those made of generally rigid plastic.

This application further describes an interactive elastic plastic container liner support system, and a passive plastic elastic container liner support system.

Holdfast for an Elastic Plastic Container Liner

This invention consists of providing holdfasts A and A' for an elastic plastic container liner 3 having an enclosed bottom 43 and side walls 44–47 joined thereto and forming an opening 60 defined by upper side wall edges 48–51 and being formed with handle openings 56 and 57 adjacent the upper side wall edges. The elastic plastic container liner is placed in a receptacle 1 having a pair of spaced upright side walls 4 and 5, each formed with an elongated generally planar substantially rigid portion 6 and 7 having inner faces 8 and 10 and outer faces 9 and 11 and terminating in elongated top edges 12 and 13 which are commonly generally horizontal. The rigid portions need not be planar, and in fact are commonly curved.

Holdfasts A and A' each consist briefly of a. a pair of holdfast means 2 and 2' each including:
   (1) a pair of generally V-shaped members 14 and 15 each having a inside edge 16 and 17 adapted for resting on the elongated top edges 12 and 13 of the receptacle 1 and each V-shaped member having first portions 18 and 19 and second portions 58 and 59 connected to the inside edges 16 and 17;
   (2) a pair of inner leg members 22 and 23 having proximate portions 24 and 25 connected to the first portions 18 and 19 of the V-shaped members and distal portions 26 and 27 extending downwardly and inwardly from the elongated top edges 12 and 13 of the receptacle 1;
   (3) a pair of inner foot members 28 and 29 respectively connected to the distal portions 26 and 27 of the inner leg members 22 and 23 extending downwardly and outwardly and terminating at end points 30 and 31 for contact with the respective inner faces 8 and 10 of the rigid portions 6 and 7 of the side walls 4 and 5 of the receptacle 1;
   (4) a pair of outer leg members 32 and 33 having proximate portions 34 and 35 connected to the second portions 58 and 59 of the V-shaped members 14 and 15 and distal portions 36 and 37 extending downwardly and outwardly from the generally horizontal elongated top edges 12 and 13 of the receptacle;
   (5) a pair of outer foot members 38 and 39 respectively connected to the distal portions 36 and 37 of the outer leg members 32 and 33 extending downwardly and inwardly for contact with the outer faces 9 and 11 of the rigid portions 6 and 7 of the sidewalls 4 and 5 of the receptacle 1;

b. a pair of arm means 40 and 41 respectively connected to the hold fast means 2 and 2' and extending upwardly therefrom; and c. a cross arm 42 joining each of the arm means 40 and 41.

Interactive Elastic Container Liner Support System

The nexus of the present support system is the fact that the holdfasts A and A' interact with the container liner support system. The holdfasts stretch the elastic container liner and in doing so two actions take place. First, by stretching the container liner, the container liner acts on the holdfasts and causes them to hold onto the receptacle even more tightly. Second, the holdfasts cause the elastic container to stretch so that the opening 60 is maximized. Moreover, the opening 60 is well defined and selectively positioned as opposed to a paper bag or loosely supported plastic container which would have a non-defined opening, and be randomly and movably positioned within the receptacle. With the well defined and selectively positioned opening, one can deposit trash and garbage in the elastic plastic container without having the trash or garbage fall down between the container liner and the receptacle.

The interactive elastic container liner support system of the present invention consists briefly of:

a. a receptacle 1 having a pair of spaced upright side walls 4 and 5, each formed with an elongated substantially rigid portion 6 and 7 having inner faces 8 and 10 and outer faces 9 and 11 and terminating in elongated top edges 12 and 13 b. a pair of holdfasts A and A' each including:
   (1) a pair of generally V-shaped members 14 and 15 each having an inside edge 16 and 17 adapted for resting on the elongated top edges 12 and 13 of the receptacle and each V-shaped member having first and second portions 18 and 19 connected to the inside edges 16 and 17;
   (2) a pair of inner leg members 22 and 23 having proximate portions 24 and 25 connected to the first portions 18 and 19 of the V-shaped members and distal portions 26 and 27 extending downwardly and inwardly from the elongated top edges 12 and 13 of the receptacle;
   (3) a pair of inner foot members 28 and 29 respectively connected to the distal portions 26 and 27 of the inner leg members 22 and 23 extending downwardly and outwardly and terminating at end points 30 and 31 for contact with the respective inner faces 8 and 10 of the rigid portions 6 and 7 of the side walls 4 and 5 of the receptacle;
   (4) a pair of outer leg members 32 and 33 having proximate portions 34 and 35 connected to the second portions 58 and 59 of the U-shaped members 14 and 15 and distal portions 36 and 37 extending downwardly and outwardly from the generally horizontal elongated top edges 12 and 13 of the receptacle;
   (5) a pair of outer foot members 38 and 39 respectively connected to the distal portions 36 and 37 of the outer leg members 32 and 33 extending downwardly and inwardly for contact with the outer faces 9 and 11 of the rigid portions 6 and 7 of the sidewalls 4 and 5 of the receptacle;
   (6) a pair of arms 40 and 41 respectively connected to the outer foot members 38 and 39 and extending upwardly therefrom; and
   (7) a cross arm 42 joining the arms 40 and 41;

c. an elastic plastic container liner 3 having an enclosed bottom 43 and side walls 44 and 47 joined thereto and forming an opening 60 defined by upper side wall edges 48–51 and being formed with handle openings 56 and 57 adjacent the upper side wall edges 49 and 51;

d. the handle openings 56 and 57 in the plastic container being engaged by the respective arms 40 and 41 of the holdfasts A and A'; and e. the receptacle upright sidewalls 4 and 5 being dimensioned and the plastic container liner 3 being dimensioned so that when the handle openings 56 and 57 of the plastic container liner 3 engage the arms 40 and 41 of the holdfasts A and A'. The plastic container liner 3 is stretched so as to bias the holdfasts toward one another and stretch the upper side wall edges 48–51 into relatively taut straight lines and to maximize and clearly define the opening 60 in the elastic plastic container liner 3.

To meet the requirements of an interactive support system, the holdfasts A and A' are constructed from a material having the physical properties of a spring.

Preferably, the holdfasts are constructed from metal wire material, but they could also be constructed from plastic materials which have the properties of a wire spring

Passiave Elastic Container Liner Support System

The holdfasts A and A' may also be used in a passive elastic container liner support system. In this system, the side walls 4 and 5 are either spaced more closely together or the elastic plastic container is larger so that when the arms 40 and 41 of the holdfasts A and A' are inserted through the handle openings 56 and 57, the elastic plastic container will not be stretched and the plastic container will hang loosely within the receptacle 1. The holdfasts A and A' are dimensioned so that it is not necessary to stretch the elastic plastic container in order for the holdfasts to hold tightly to the sides of the receptacle.

As shown in the illustrations, the passive elastic container liner support system consists briefly of:

a. a receptacle 1 having a pair of spaced upright side walls 4 and 5, each formed with an elongated substantially rigid portion 6 and 7 having inner faces 8 and 10 and outer faces 9 and 11 and terminating in generally horizontal elongated top edges 12 and 13;

b. a pair of holdfasts A and A' each including:

(1) a pair of generally V-shaped members 14 and 15 each having an inside edge 16 and 17 adapted for resting on the elongated top edge 12 and 13 of the receptacle and each V-shaped member having first portions 18 and 19 and second portions 58 and 59 connected to the inside edges;

(2) a pair of inner leg members 22 and 23 having proximate portions 24 and 25 connected to the first portions 18 and 19 of the V-shaped members and distal portions 26 and 27 extending downwardly and inwardly from the elongated top edges of said receptacle;

(3) a pair of inner foot members 28 and 29 respectively connected to the distal portions 26 and 27 of the inner leg members extending downwardly and outwardly and terminating at end points 30 and 31 for contact with the respective inner faces 8 and 16 of the rigid portions of the side walls of the receptacle;

(4) a pair of outer leg members 32 and 33 having proximate portions 34 and 35 connected to the second portions 58 and 59 of the V-shaped members and distal portions 36 and 37 extending downwardly and outwardly from the elongated top edges of the receptacle;

(5) a pair of outer foot members 38 and 39 respectively connected to the distal portions 36 and 37 of the outer leg members extending downwardly and inwardly for contact with the outer faces 9 and 11 of the rigid portions of the sidewalls of the receptacle;

(6) a pair of arms 40 and 41 respectively connected to the outer foot members 38 and 39 and extending upwardly therefrom; and (7) a cross arm 42 joining the arms;

c. an elastic plastic container liner 3 having an enclosed bottom 43 and side walls 44–47 joined thereto and forming an opening 60 defined by upper side wall edges 48–51 and being formed with handle openings 56 and 57 adjacent the upper side wall edges 49 and 51;

d. the handle openings 56 and 57 in the plastic container liner 3 being engaged by the respective arms of the holdfasts; and e. the receptacle upright sidewalls 4 and 5 are dimensioned and the plastic container liner 3 is dimensioned so that when the handle openings 56 and 57 of the plastic container liner engage the arms 40 and 41 of the holdfasts A and A', the plastic container liner hangs loosely within the receptacle.

In the passive elastic container liner support system, the holdfasts may be constructed from either a wire or plastic member. There is no need, however, for the plastic or the metal wire member to have spring characteristics.

Operation of the Interactive Elastic Container Liner Support System

Operation of the interactive elastic container liner support system is extremely simple. Referring to the illustrations in FIGS. 1–6, holdfasts A and A' are slipped down over the top edges 12 and 13 of receptacle 1. As previously noted, the receptacle may be constructed with or without a flanged rim around the top edge of the receptacle. The holdfasts may be placed over the receptacle edge as shown in the illustrations or reversed, but preferably, the inner leg members 22 and 23 are placed along the inner faces 8 and 10 of the side walls 4 and 5 of the receptacle. Note that the receptacle need not be a solid wall but may even be a basket with woven or side openings so long as there is a rigid portion 6 and 7 against which the inner end points 30 and 31 and the outer foot members 38 and 39 may rest. The third side of the triangular support is provided by the engagement of the apexes 20 and 21 of the inside edges 16 and 17 resting on the top edges 12 and 13 of the receptacle.

There is no fitting or special twisting or turning of the holdfasts in order to attach them to the receptacle. The holdfasts are simply positioned above the edge of the receptacle and dropped on.

Next, the handle opening 56 of the elastic plastic container liner 2 is dropped down over the arms 40 and 41. The final step is to stretch the top of the elastic plastic container liner and place the other handle opening 57 over one arm 40 of the holdfast and then slide the opening 57 over cross arm 42 and down over the other arm 41. At this point, the elastic plastic container liner is ready for the receipt of waste material or garbage.

To make a neater fit and more attractive appearance, the handles 61 and 62 may be pressed down on arms 40 and 41 until the handles of the plastic container liner rest on top edges 12 and 13 of the receptacle.

Since the elastic plastic container is in tension, the arms 40 and 41 of the holdfasts A and A' are bent toward one another. Due to the unique configuration of the holdfasts, an interesting gripping action takes place. Outer foot members 38 and 39 of holdfasts A and A' are forced more tightly against the outside faces 9 and 11 of the rigid portions 6 and 7, unexpectedly, because of the tipping of the holdfasts A and A' toward one another, end points 30 and 31 of each holdfast also grips more firmly the inner faces 8 and 10 of rigid portions 6 and 7 of the receptacle.

In like manner, as waste material is placed in the elastic plastic container liner, the holdfasts A and A' continue to grip the receptacle more tightly in the same manner just described.

To remove the plastic container liner, it is simply necessary to slip the handles 61 and 62 up over the arms 40 and 41 and the cross arm 42 of each holdfast. The holdfasts may remain on the receptacle or they may be removed before replacing the elastic plastic container with a new one.

It is unlikely that the handles would ride up the arms 40 and 41, but in the event they did, the handles would be caught in the bend points 54 and 55 of the arms.

Modified Holdfast

A modified form of the invention is illustrated in FIGS. 7–10. The modified form of the invention consists of providing holdfasts AA and AA' for an elastic plastic container liner 3 having an enclosed bottom 43 and side walls 44–47 joined thereto and forming an opening 60 defined by upper side wall edges 48–51 and being formed with handle openings 56 and 57 adjacent the upper side wall edges. The elastic plastic container liner is placed in a receptacle 1 having a pair of spaced upright side walls 4 and 5, each formed with an elongated substantially rigid portion 6 and 7 having inner faces 8 and 10 and outer faces 9 and 11 and terminating in elongated top edges 12 and 13.

Holdfasts AA and AA' each consist briefly of a. a pair of holdfast means 102 and 102' each including:

(1) a pair of generally V-shaped members 114 and 115 each having a curvilinear edge 116 and 117 adapted for resting on the elongated top edges 12 and 13 of the receptacle 1 and each V-shaped member having first portions 118 and 119 and second portions 158 and 159 connected to the inside edges 116 and 117;

(2) a pair of inner leg members 122 and 123 having proximate portions 124 and 125 connected to the first portions 118 and 119 of the V-shaped members and distal portions 126 and 127 extending downwardly and inwardly from the elongated top edges 12 and 13 of the receptacle 1;

(3) a pair of inner foot members 128 and 129 respectively connected to the distal portions 126 and 127 of the inner leg members 122 and 123 extending downwardly and outwardly and terminating at end points 130 and 131 for contact with the respective inner faces 8 and 10 of the rigid portions 6 and 7 of the side walls 4 and 5 of the receptacle 1;

(4) a pair of outer leg members 132 and 133 having proximate portions 134 and 135 connected to the second portions 158 and 159 of the V-shaped members 114 and 115 and distal portions 136 and 137 extending downwardly and outwardly from the elongated top edges 12 and 13 of the receptacle;

(5) a pair of outer foot members 138 and 139 respectively connected to the distal portions 136 and 137 of the outer leg members 132 and 133 extending downwardly and inwardly for contact with the outer faces 9 and 11 of the rigid portions 6 and 7 of the sidewalls 4 and 5 of the receptacle 1;

b. a pair of arm means 140 and 141 respectively connected to the hold fast means 102 and 102' and extending upwardly therefrom; and c. a cross arm 142 joining each of the arm means 140 and 141.

Holdfasts AA and AA' may be made entirely of plastic, but preferably, all but the cross arm 142 is made of plastic and the cross arm is made of metal.

Figure 9:
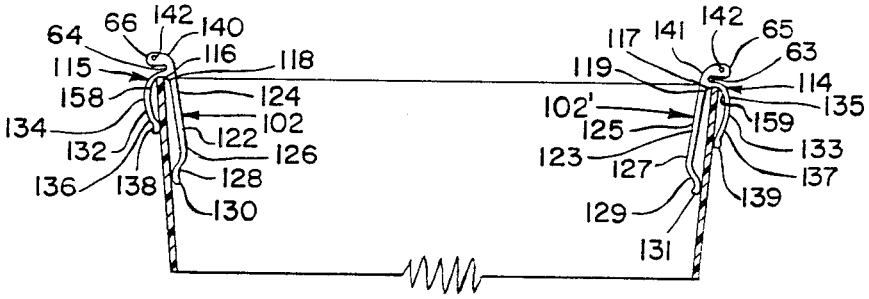
FIG. 9 is a side view of the modified form of the invention illustrated in FIG. 7 on a reduced scale.
Figure 10:
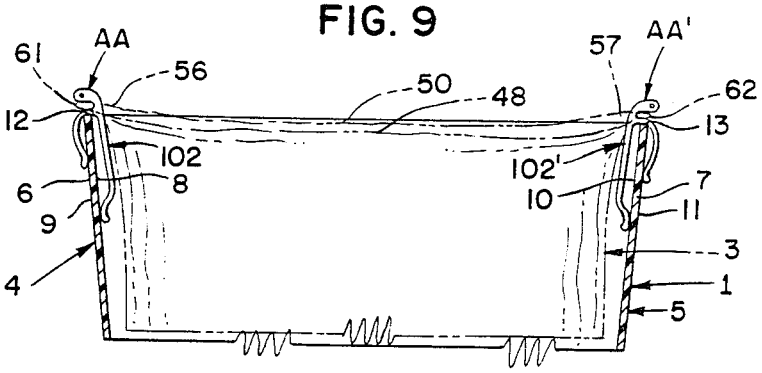
FIG. 10 is a side view similar to FIG. 9 but with the addition of a plastic container liner shown in phantom line.

As shown in FIG. 9, the installation of the holdfasts is the same as heretofore described. The operation, however, is slightly different and will be described hereafter with reference to FIG. 10.

For example, handle 62 is placed in the groove 63 formed in holdfast AA' by inserting it over end 65 of arm 141. Next, handle 61 is inserted into groove 64 in arm 140 by inserting it over end 66. Since there is relatively little "spring" in the plastic holdfasts shown in FIGS. 7–10, in most instances the holdfasts will not hold the plastic container liner in tension.

The main feature, however, of the plastic holdfasts is that they may be colored and the profile is much lower than the metal holdfasts so that the container and holdfasts may be used where there is less head clearance as for example in cabinets under kitchen sinks.

We claim:

1. A holdfast for an elastic plastic container liner having an enclosed bottom and side walls joined thereto and forming an opening defined by upper side wall edges and being formed with handle openings adjacent said upper side wall edges; said elastic plastic container liner being placed in a receptacle having a pair of spaced upright side walls, each formed with an elongated substantially rigid portion having inner and outer faces and terminating in elongated top edges, said holdfast comprising;

a. a pair of holdfast means each including:

(1) a pair of generally V-shaped members each having an inside edge adapted for resting on said elongated top edge of said receptacle and each V-shaped member having first and second portions connected to said inside edges;

(2) a pair of inner leg members having proximate portions connected to said first portions of said V-shaped members and distal portions extending downwardly and inwardly from said elongated top edges of said receptacle;

(3) a pair of inner foot members respectively connected to said distal portions of said inner leg members extending downwardly and outwardly and terminating at end points for contact with said respective inner faces of said rigid portions of said side walls of said receptacle;

(4) a pair of outer leg members having proximate portions connected to said second portions of said V-shaped members and distal portions extending downwardly and outwardly from said elongated top edges of said receptacle;

(5) a pair of outer foot members respectively connected to said distal portions of said outer leg members extending downwardly and inwardly for contact with said outer faces of said rigid portions of said sidewalls of said receptacle;

b. a pair of arm means respectively connected to said hold fast means and extending upwardly therefrom; and c. a cross arm joining each of said arm means.

2. An interactive elastic container liner support system comprising;

a. a receptacle having a pair of spaced upright side walls, each formed with an elongated substantially rigid portion having inner and outer faces and terminating in elongated top edges;

b. a pair of holdfasts each including:

(1) a pair of generally V-shaped members each having an inside edge adapted for resting on said elongated top edge of said receptacle and each V-shaped member having first and second portions connected to said inside edges;

(2) a pair of inner leg members having proximate portions connected to said first portions of said V-shaped members and distal portions extending downwardly and inwardly from said elongated top edges of said receptacle;

(3) a pair of inner foot members respectively connected to said distal portions of said inner leg members extending downwardly and outwardly and terminating at end points for contact with said respective inner faces of said rigid portions of said side walls of said receptacle;

(4) a pair of outer leg members having proximate portions connected to said second portions of said V-shaped members and distal portions extending downwardly and outwardly from said elongated top edges of said receptacle;

(5) a pair of outer foot members respectively connected to said distal portions of said outer leg members extending downwardly and inwardly for contact with said outer faces of said rigid portions of said sidewalls of said receptacle;

(6) a pair of arms respectively connected to said outer foot meabers and extending upwardly therefrom; and (7) a cross arm joining said arms;

c. an elastic plastic container liner having an enclosed bottom and side walls joined thereto and forming an opening defined by upper side wall edges and being formed with handle openings adjacent said upper side wall edges;

d. said handle openings in said plastic container being engaged by said respective arms of said holdfasts; and e. said receptacle upright sidewalls being dimensioned and said plastic container liner being dimensioned so that when said handle openings of said plastic container liner engage said arms of said holdfasts, said plastic container liner is stretched so as to bias said holdfasts toward one another and stretch said upper side wall edges into relatively taut straight lines and to maximize and clearly define said opening in said elastic plastic container liner.

3. A support system as described in claim 2 wherein:

a. said holdfasts are constructed from a material having the physical properties of a spring.

4. A support system as described in claim 2 wherein:

a. said holdfasts are constructed from metal wire material.

5. A support system as described in claim 2 wherein:

a. said holdfasts are constructed from plastic material except for said cross arms; and b. said cross arms are constructed from metal.

6. A passive elastic container liner support system comprising;

a. a receptacle having a pair of spaced upright side walls, each formed with an elongated substantially rigid portion having inner and outer faces and terminating in elongated top edges;

b. a pair of holdfasts each including:

(1) a pair of generally V-shaped members each having an inside edge adapted for resting on said elongated top edge of said receptacle and each V-shaped member having first and second portions connected to said inside edges;

(2) a pair of inner leg members having proximate portions connected to said first portions of said V-shaped members and distal portions extending downwardly and inwardly from said elongated top edges of said receptacle;

(3) a pair of inner foot members respectively connected to said distal portions of said inner leg members extending downwardly and outwardly and terminating at end points for contact with said respective inner faces of said rigid portions of said side walls of said receptacle;

(4) a pair of outer leg members having proximate portions connected to said second portions of said V-shaped members and distal portions extending downwardly and outwardly from said elongated top edges of said receptacle;

(5) a pair of outer foot members respectively connected to said distal portions of said outer leg members extending downwardly and inwardly for contact with said outer faces of said rigid portions of said sidewalls of said receptacle;

(6) a pair of arms respectively connected to said outer foot members and extending upwardly therefrom; and (7) a cross arm joining said arms;

c. an elastic plastic container liner having an enclosed bottom and side walls joined thereto and forming an opening defined by upper side wall edges and being formed with handle openings adjacent said upper side wall edges;

d. said handle openings in said plastic container liner being engaged by said respective arms of said holdfasts; and e. said receptacle upright sidewalls being dimensioned and said plastic container liner being dimensioned so that when said hand holds of said plastic container liner engage said arms of said holdfasts, said plastic container liner hangs loosely within said receptacle.

7. A support system as described in claim 6 wherein:

a. said holdfasts are constructed from a wire member.

8. A support system as described in claim 6 wherein:

a. said holdfasts are constructed from plastic except said cross arm; and b. said cross arm is constructed from wire material.

9. A holdfast for an elastic plastic container liner having an enclosed bottom and side walls joined thereto and forming an opening defined by upper side wall edges and being formed with handle openings adjacent said upper side wall edges; said liner being placed in a receptacle having a pair of spaced upright side walls, each formed with an elongated generally planar substantially rigid portion having inner and outer faces and terminating in a generally horizontal elongated top edge; said holdfast comprising;

a. a pair of generally U-shaped members each having a curvilinear edge adapted for resting on said elongated top edge of said receptacle and each U-shaped member having first and second portions connected to said curvilinear edges;

b. a pair of inner leg members having proximate portions connected to said first portions of said U-shaped members and distal portions extending downwardly and inwardly from said generally horizontal elongated top edges of said receptacle;

c. a pair of inner foot members respectively connected to said distal portions of said inner leg members extending downwardly and outwardly and terminating at end points for contact with said respective inner faces of said rigid portions of said side walls of said receptacle;

d. a pair of outer leg members having proximate portions connected to said second portions of said u-shaped members and distal portions extending downwardly and outwardly from said generally horizontal elongated top edges of said receptacle;

e. a pair of outer foot members respectively connected to said distal portions of said outer leg members extending downwardly and inwardly for contact with said outer faces of said rigid portions of said sidewalls of said receptacle;

f. a pair of arms respectively connected to said outer foot members and extending upwardly therefrom; and g. a cross arm joining said arms.

* * * * *